US009551477B2

(12) United States Patent
Chien

(10) Patent No.: US 9,551,477 B2
(45) Date of Patent: Jan. 24, 2017

(54) MORE THAN ONE LEVEL(S) LED BULB HAS MULTIPLE FEATURES

(71) Applicant: Tseng-Lu Chien, Walnut, CA (US)

(72) Inventor: Tseng-Lu Chien, Walnut, CA (US)

( * ) Notice: Subject to any disclaimer, the term of this patent is extended or adjusted under 35 U.S.C. 154(b) by 0 days.

(21) Appl. No.: 14/289,968

(22) Filed: May 29, 2014

(65) Prior Publication Data

US 2015/0070897 A1 Mar. 12, 2015

Related U.S. Application Data

(63) Continuation-in-part of application No. 14/280,865, filed on May 19, 2014, which is a continuation of application No. 13/540,728, filed on Jul. 3, 2012, now Pat. No. 8,834,009, which is a continuation-in-part of application No. 13/296,460, filed on Nov. 15, 2011, now Pat. No. 8,812,517, and a continuation-in-part of application No. 13/296,469, filed on Nov. 15, 2011, now Pat. No. 8,711,216.

(51) Int. Cl.

| | |
|---|---|
| ***F21S 4/00*** | (2016.01) |
| ***F21V 14/02*** | (2006.01) |
| ***F21V 29/00*** | (2015.01) |
| ***F21V 5/04*** | (2006.01) |
| ***F21V 23/04*** | (2006.01) |
| *F21W 131/30* | (2006.01) |
| *F21Y 101/00* | (2016.01) |

(52) U.S. Cl.

CPC ..... *F21V 14/02* (2013.01); *F21K 9/232* (2016.08); *F21K 9/60* (2016.08); *F21K 9/65* (2016.08); *F21V 5/04* (2013.01); *F21V 23/0442* (2013.01); *F21V 29/20* (2013.01); *F21W 2131/30* (2013.01); *F21Y 2101/00* (2013.01)

(58) Field of Classification Search

CPC ..... H04N 7/181; F21S 8/038; F21S 10/002; F21V 21/08

USPC ..... 362/249.02

See application file for complete search history.

(56) References Cited

U.S. PATENT DOCUMENTS

| | | | | |
|---|---|---|---|---|
| 8,113,698 | B2 * | 2/2012 | Wu et al. | 362/373 |
| 8,847,491 | B2 * | 9/2014 | Yotsumoto | F21V 33/0056 315/149 |
| 9,081,269 | B2 * | 7/2015 | Conti | F21K 9/135 |
| 9,107,248 | B2 * | 8/2015 | Chen | H05B 37/0218 |
| 9,134,012 | B2 * | 9/2015 | Wu | F21V 14/02 |
| 9,206,952 | B2 * | 12/2015 | Gold | F21L 15/08 |
| 9,217,555 | B2 * | 12/2015 | Farmer | F21V 29/20 |
| 2011/0116266 | A1 * | 5/2011 | Kim | F21V 19/02 362/249.02 |
| 2014/0306599 | A1 * | 10/2014 | Edwards | F21V 3/02 313/502 |

* cited by examiner

*Primary Examiner* — Anabel Ton

(74) *Attorney, Agent, or Firm* — Bacon & Thomas, PLLC

(57) ABSTRACT

An LED bulb has more than one movable level that can change position to avoid blocking or interference with heat dissipation, light emission or projection, or control signal transmission. The LED bulb offers nearby and far away illumination or any combination of other light effects, image projection, or digital data image display, and may function in response to a power failure remote control or control by an infrared controller, Bluetooth controller, WiFi, Internet, or app software control, or a motion sensor.

17 Claims, 9 Drawing Sheets

(co-pending drawing)

Fig 2A
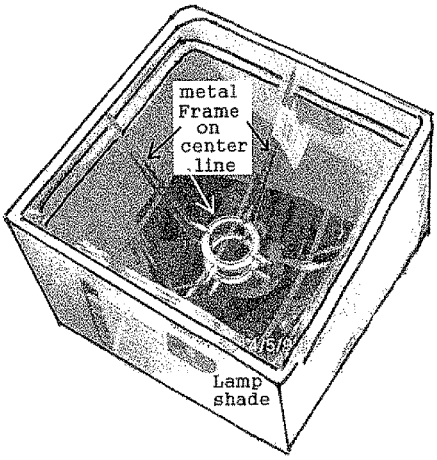
metal Frame
on center line
Fig 2B
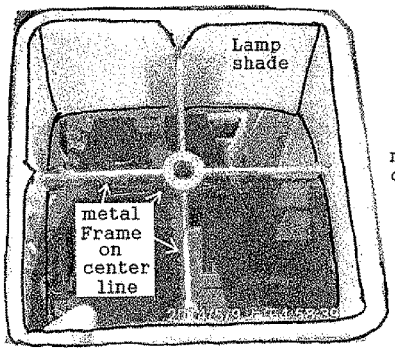
Lamp shade has metal frame and accessories to hold with light source. Some metal frame on top of the Bulb so will block out the light traveling or signal transmit such as Wifi, bluetooth, remote control, motion sensor etc.
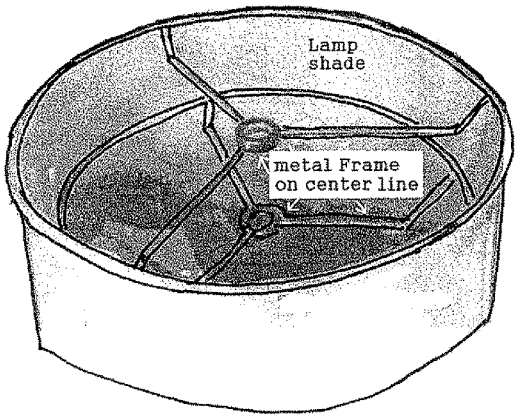
Fig 2C
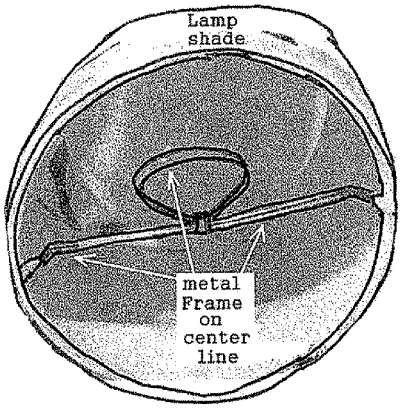
Fig 2D
Fig (2a) (2b)(2c)(2d) lamp shade has metal block-means to interfer bulb's light beam to travel.

Fig 5a
(parent filing drawing)
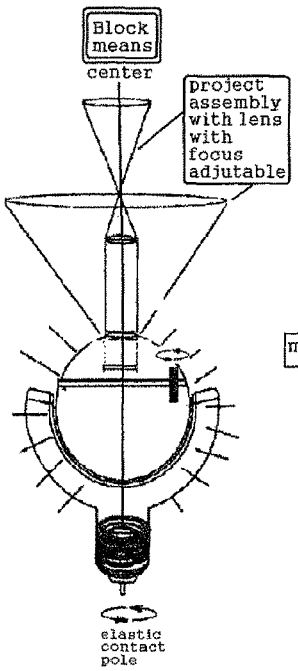
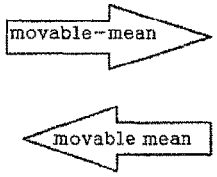
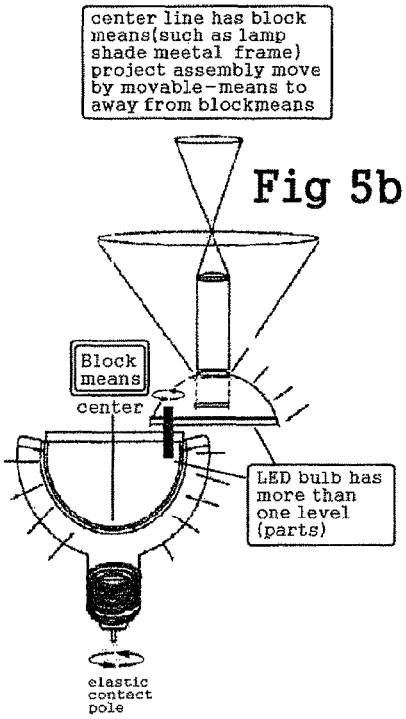
Fig 5b
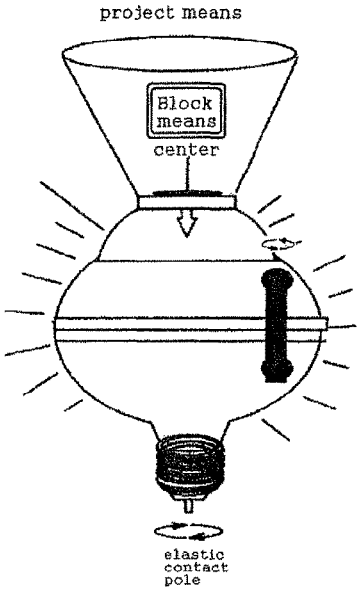
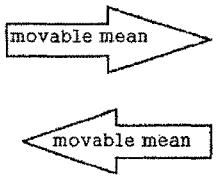
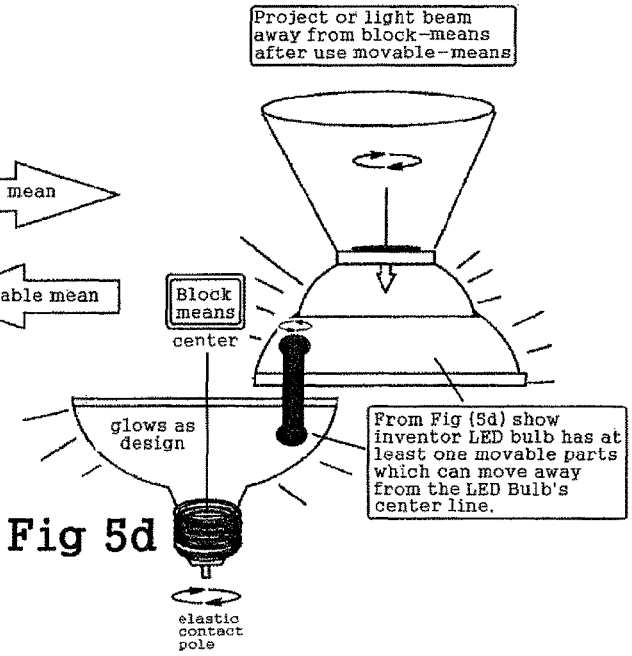
Fig 5d
Fig 5c
(parent filing drawing)

Fig 6a
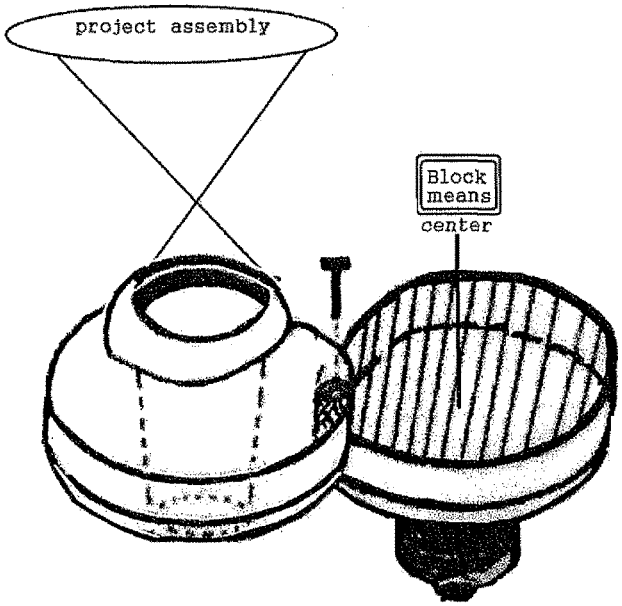
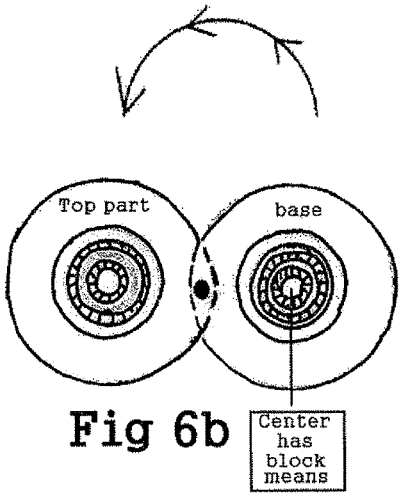
Fig 6b
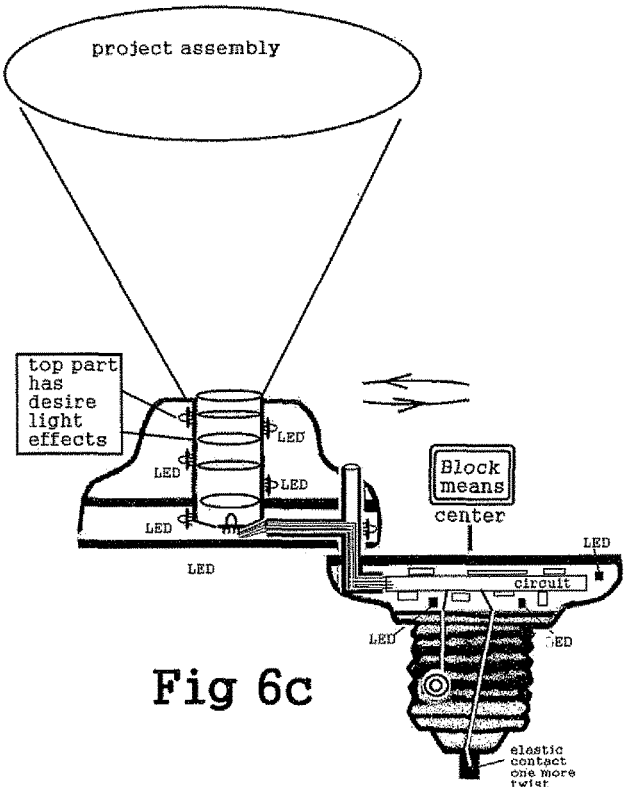
Fig 6c

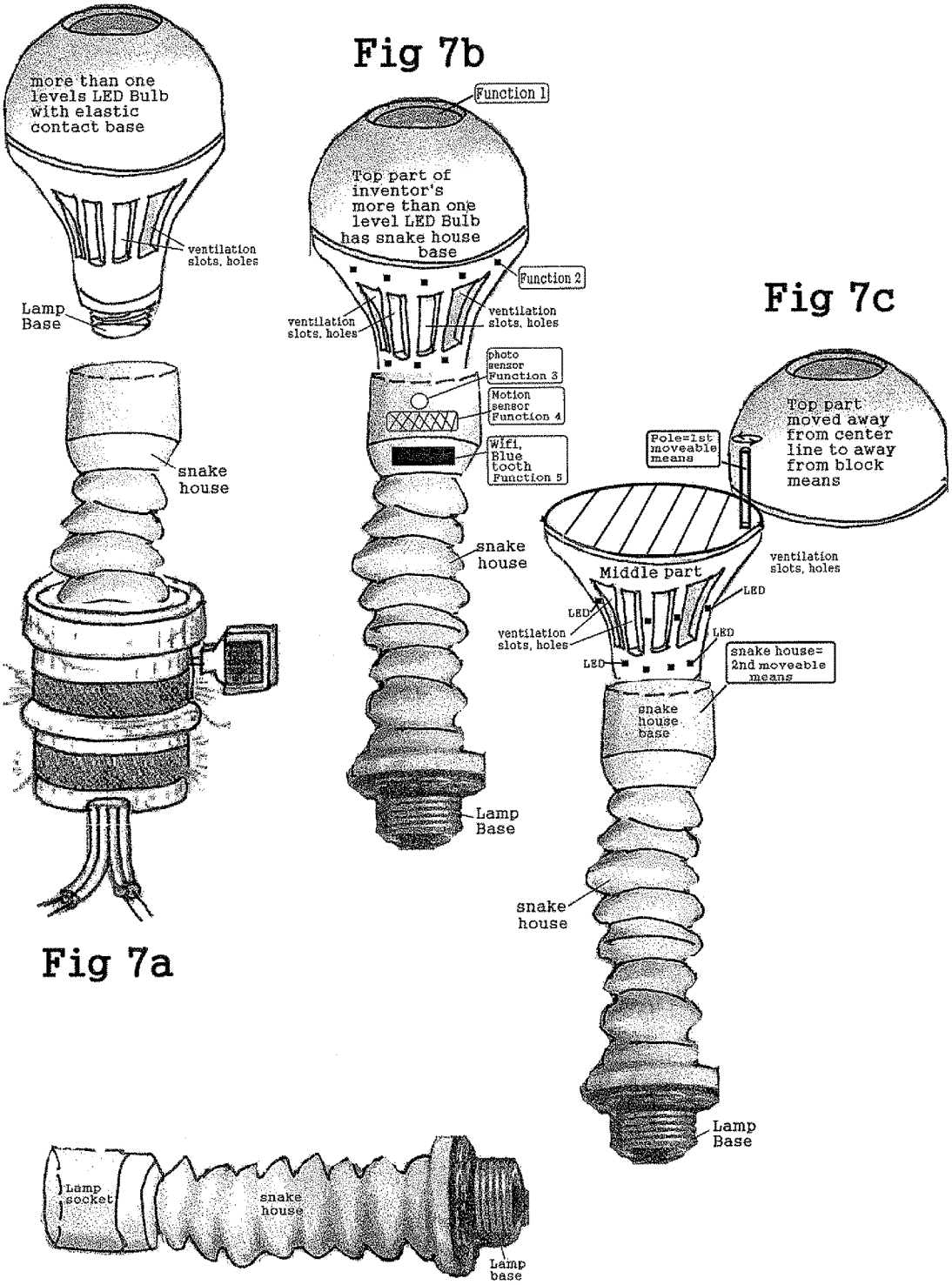
more than one levels LED Bulb with elastic contact base
ventilation slots, holes
Lamp Base
snake house
Fig 7b
Function 1
Top part of inventor's more than one level LED Bulb has snake house base
Function 2
ventilation slots, holes
ventilation slots, holes
photo sensor Function 3
Motion sensor Function 4
Wifi, Blue tooth Function 5
snake house
Lamp Base
Fig 7c
Top part moved away from center line to away from block means
Pole=1st moveable means
ventilation slots, holes
Middle part
LED
LED
ventilation slots, holes
LED
LED
snake house= 2nd moveable means
snake house base
snake house
Lamp Base
Fig 7a
Lamp socket
snake house
Lamp base

MORE THAN ONE LEVEL(S) LED BULB HAS MULTIPLE FEATURES

This application is a continuation-in-part of U.S. patent application Ser. No. 14/280,865, filed May 19, 2014, which is a continuation of U.S. patent application Ser. No. 13/540,728, filed Jul. 3, 2013, now allowed, which is a continuation-in-part of U.S. patent application Ser. Nos. 13/296,508, 13/296,460, and 13/296,469, each filed Nov. 15, 2011 and incorporated herein by reference.

BACKGROUND OF THE INVENTION

The current invention relates to various improvements to the LED devices disclosed in the parent applications, which include the following features: (1) a projection light; (2) more than one function; (3) adjustable focus; (4) adjustable angle; (5) elastic contact points; (6) LED heat dissipation; (7) heat sensitive parts installation; and (8) extendability. The improvements include the provision of a movable-means to allow at least one level of a multi-level LED bulb to be moved away from original position, location, or orientation to avoid interference with or blocking of light or electromagnetic wave transmission to or from the LED bulb while solving heat issues with the LED(s), circuitry, or electric components, including blocking by a lamp shade's metal frame of light from the LED bulb and interference by glass, metal, or cement structures with electromagnetic signals transmitted to or from Bluetooth means, WiFi means, Internet means, app software means, or any other electromagnetic transmissions used to control the LED bulb and its related electric parts or accessories.

The following U.S. patent applications of the inventor have subject matter in common with the present invention, and the features disclosed therein may be combined with those of the preferred embodiments without departing from the scope of the present invention:

U.S. patent application Ser. Nos. 13/367,758, 13/367,687, 13/296,508, 13/295,301, 13/021,107, 12/950,017, 12/938,564, 12/886,832, 12/876,507, 12/771,003, 13/021,124, 12/624,621, 12/622,000, 12/318,470, 12/914,584, 12/834,435, 12/292,153, 12/907,443, 12/232,505, 11/806,711, and 11/806,285.

This application is also related to U.S. patent application Ser. No. 12/951,501 "Lamp Holder Has Built-In LED Night Light";

Ser. No. 12/950,017 "Multiple Surface LED Light"; Ser. No. 13/162,824 "Light Device With Display Means Has Track-Means and Removable LED-Unit(s)"; Ser. No. 12/938,628 "LED Light Fixture Has Outlet(s) And Removable LED Unit(s)"; and Ser. No. 12/887,700 "Light Fixture With Self-Power Removable LED Unit(s)," as well as the inventor's U.S. Pat. Nos. 7,722,230, and 7,726,869, U.S. patent application Ser. No. 12/073,889, U.S. Pat. Nos. 7,726,841 and 7,726,839, and U.S. patent application Ser. No. 12/894,865.

Still further U.S. patent applications of the inventor that have subject matter in common with the present invention include: U.S. patent application Ser. Nos. 12/624,621, 12/622,100, 12/318,471, 12/318,470, 12/318,473, 12/292,153, 12/232,505, 12/232,035, 12/149,963, 12/149,964, 12/073,095, 12/073,889, 12/007,076, 12/003,691, 12/003,809, 11/806,711, 11/806,285, 11/806,284, 11/566,322, 11/527,628, 11/527,629, 11/498,874, 12/545,992, 12/806,711, 12/806,285, 12/806,284, 12/566,322, 12/527,628, 12/527,629, 12/527,631, 12/502,661, 11/498,881, 11/255,981, 11/184,771, 11/152,063, 11/094,215, 11/092,742, 11/092,741, 11/094,156, 11/094,155, 10/954,189, 10/902,123, 10/883,719, 10/883,747, 10/341,519, 12/545,992, 12/292,580, 12/710,918, 12/624,621, 12/622,000, 12/318,471, 12/318,470, 12/318,473, 12/292,153, 12/710,561, 12/710,918, 12/711,456, 12/771,003 The LED bulb of the current invention for has at least one level and movable means to cause the at least one level of the LED Bulb to change its position, location, and/or orientation away from an original position while providing desired light functions, performance, or effects.

The at least one level (or parts or accessories) are incorporated with the movable-means so that the at least one of level (including parts or accessories) can be moved away from the original position, location, and/or orientation so as to overcome a blocking-means which affects or interferes desired functions of the LED bulb.

One problem addressed by the present invention is that, in a multi-level LED bulb having projection functions that is installed on a desk lamp, floor lamp, downwardly facing light, indoor lighting or outdoor lighting, the lamp shade, has a metal frame and ring on the center line of the LED bulb's and lamp socket, will block the top part of the projection light's image and destroy the projection image performance. The current invention solves this problem by letting the top part of the LED projection light move away from the lamp shade's metal frame and metal ring so that the projected LED beam will not pass through any blocking-means but rather will be free to create the desired image/message/time/digital data/digital image/LCD display image/arts on the ceiling surface. If one uses the traditional LED projection bulb, the lamp shade blocking-means will totally destroy the LED projection light performance.

The current invention also can solve the heat issues of all market available LED bulbs. The simple solution is to locate the LED(s) and electric parts, accessories, and components on the base part of the more than one level LED bulb or at least on one level of the LED bulb that has movable-means such as spinning or rotating mechanisms, hinges, arms, joint pieces, connecting pieces, and extendable or extractable means to move the heat source away from other parts of the LED bulb.

For example (1) all electric parts may be put on a top part of the LED bulb disclosed in the parent application so that all heat will move to top areas, or (2) all electric parts may be put on a base part and the top parts moved away from the base part so that the heat will not affect to the other parts. Both solutions use movable-means in the form of extractable means, extendable means, movable parts or accessories, rotating means, pole means, hinge means, arm means, bar means, snake-house means or any other means that can move the parts to another location so as to easily overcome the heat issues. The term "snake hose" refers to a bellows or accordion-like construction.

The current invention can be used for both upwardly facing and downwardly facing or recessed installation because the movable-means including extractable and extendable means can overcome the disadvantage of downward light applications (i.e., applications in which the LED bulb base is on top) that the lamp shade, which may be made of glass, metal, cement, or concrete, will affect or interfere with the transmission of electric signals that enable Bluetooth control, WiFi control, remote control, infrared control, Internet control, or app software control. The movable-means of the current invention helps to overcome any electric signal blocking means, such as the lamp shade or materials surrounding a recess, and enable the LED bulb to carry out its designed and predetermined functions without being affected by, or interfered with, or limited by the said electric signal block-means.

Each level of the more than one level LED bulb can have its own functions, features, or multiple functions/features that are controlled by market available skill or methods selected from Bluetooth, WiFi, Internet, app software, IC, remote signal, infrared signal, motion sensor, or heat sensor control, implemented by a user through a computer, communication device, or other consumer device. The multiple levels of the LED bulb can have: (1) multiple colors with changeable colors and moving effects; (2) multiple functions selected from market available LED light effects for indoor and outdoor lighting; (3) multiple control means selected from a market available control, sensor, switch, Bluetooth, WiFi, Internet, app software, remote, infrared or other electric or electronic related circuit or device; (4) more than one movable-means; (5) changeable geometric shapes; (6) changeable construction; (7) movable means selected from a bar, pole, spinning or rotating mechanism, hinge, arms, joints, or movement-enabling frame, connector, or sections to cause the levels, parts, or accessories to be move to a desired location or position.

Additional features of the invention include the following:

1. The LED bulb has the property that the LED bulb can be twisted over an additional degree or twist angle after the LED Bulb's contact-point touches an electrode in the holder, enabling horizontal positioning over an angle of more than 360 degrees when positioning a light beam to desired area(s) to obtain a wider adjustment angle or wider range of adjustment directions, and with the additional feature of incorporating an adjustable focus means to cause the LED light beams or image to provide different light performances on any desired locations or area(s). The LED bulb may include a rotatable LED Ball with two arms so that an LED bulb of preferable geometric shape and construction may also have a vertical adjustment angle of up to more than 360 degrees so that the LED bulb's plurality of light beams can cover all x-y-z axis areas by at least one of light beam or a plurality of the light beams and illuminate both nearby and faraway or remote areas.

2. The LED Bulb may have one or more than one light source arranged in the LED bulb to provide a desired light performance as described in the inventor's copending U.S. patent applications, which describe a night light with more than one LED light source or LED projection assembly. A difference with respect to the prior arrangements is that a night light has prong means for outlet installation and does not have extendable/retractable means.

3. The current invention includes an LED Bulb with adjustable focus means to enable light beams from the same LED bulb to be emitted to any desired surface(s) with a desired light performance, including a desired brightness, size, light spots, color, or lit-areas. The same light beam output from the same LED bulb with focus adjustable means enables a user to create different light patterns, light paths, light brightness, light performance, and light direction.

4. The LED bulb of the current invention has extendable means, such as an extension tube, telescope tube or equivalent extendable and receivable means that enable the electric parts and accessories of the LED bulb to keep away from the LED's heat, and away from any light blocking-means in the LED bulb, such as a curtain, shade, glass, recess lighting cylinder tube, or other blocking-means that would otherwise block a motion-sensor lens, remote control signal, or light beam emission direction, the extendable means further keeping the LED bulb's circuit board/control means/IC means/switch means/sensor means/electric parts or assembly means away from the LED-units to thereby prevent heat from affecting desired functions or performance, such as the performance of a motion sensor, PIR sensor head, Fresnel lens, or LED-unit light beam emitting direction.

5. The LED bulb of the current invention may have an extractable/extendable/movable means to put heat sensitive or light sensitive parts away from the LEDs' heat, light shade, curtain, glass, decorative material, ceiling blocking means, or any other light blocking means that might interfere with operation of the LED bulb or LED bulb's related parts and accessories. The extendable or extractable means preferably being situated at the front of the LED bulb, although the position will depend on the different requirements and different considerations with respect to heat and light blocking-means, and the ability to offer more space to install the preferred electric parts and accessories, the extra length provided by the extractable/extendable/movable means having the effect of moving sensitive parts far away from the heat source or blocking means so that the LED bulb can overcome the effects of heat and blocking means for any application or installation.

6. The current invention is different from all market-available LED bulbs which offer illumination that only covers an adjacent area starting from the LED Bulb to a certain distance (illumination surrounding the LED bulb) and do not offer illumination or images in areas in certain directions, angles, and distances that are faraway or remote from the LED bulb. The current invention offers any combination of nearby area illumination and faraway area illumination.

7. The current invention provides an LED bulb that may have more than one light beam output to different areas, directions, and locations, including areas that may not be adjacent, linked, or situated together. By offering illumination of more than one area, the invention allows people to save energy by providing illumination exactly where needed. For example, stair lighting only requires up-or-down two-direction illumination. Rest areas do not need light at all, and the stair-lighting may further have a built in motion sensor having sensitivity up to 10-30 feet, which is enough to cover one flight of stairs (normally is 18 steps). Rest areas do not need light at all, and the stair-lighting may further have a built in motion sensor having sensitivity up to 10-30 feet, which is enough to cover one flight of stairs (normally is 18 steps). One light beam from an LED bulb can reach nine steps going up and one light beam from the same LED bulb can reach nine steps going down. This is enough illumination because each UP or DOWN stair are been illuminated by each floor's one LED bulb, with two different of light beams covering nine steps up and nine steps down. This provides pretty a good power saving device while the motion sensor device ensures that only one of the two light beams needs to be output from the LED bulb at any one time.

Hence, the current invention can output at least one or a plurality of light beams from one LED bulb to nearby areas, remote areas, faraway areas, or any combination of these areas with adjustable angle, adjustable focus, elastic contact points, a rotate/spin/tilt frame or support or base to obtain a desired light beam emission direction, and extendable/retractable means to install all parts and accessories away from heat or blocking means, thereby providing a lighting device that lets all light beams be emitted to areas where they are needed for illumination, unlike conventional LED bulbs that can only illuminate nearby areas which start from the LED-bulb to a certain limited distance areas (conventional LED bulbs have insufficient brightness to emit light over long distances unless an optics lens or lens assembly is provided to project light beams to remote or faraway distances which the current market items cannot accomplish).

BRIEF DESCRIPTION OF THE DRAWINGS

FIGS. 2A, 2B, 2C, and 2D show applications of the first embodiment to a desk or floor lamp having a lamp shade having top or side metal frames and center ring that will block out the LED bulb light beams to form a shadow when the movable level(s) is in a retracted position.

FIGS. 5A, 5B, 5C, 5D, 6A, 6B, and 6C a different LED bulb having more than one level and its own movable-means to move at least one level's parts or accessories away from their original locations to a desired location, place, and/or orientation, the LED bulb having any geometric shape and number of levels as needed, and each level having its preferred one or more electric or electronic functions selected from the marketplace.

FIGS. 7A, 7B, and 7C a snake-house or joint-piece type movable-means for different LED bulbs, with FIG. 7A showing a separate snake-house and LED bulb, FIG. 7B showing an LED bulb having a built-in snake-house base, and FIG. 7C showing a built-in snake base in which one level of the LED bulb has been moved away from the center line to overcome the lamp-shade block means.

Figures 1A, 1B, 1C:
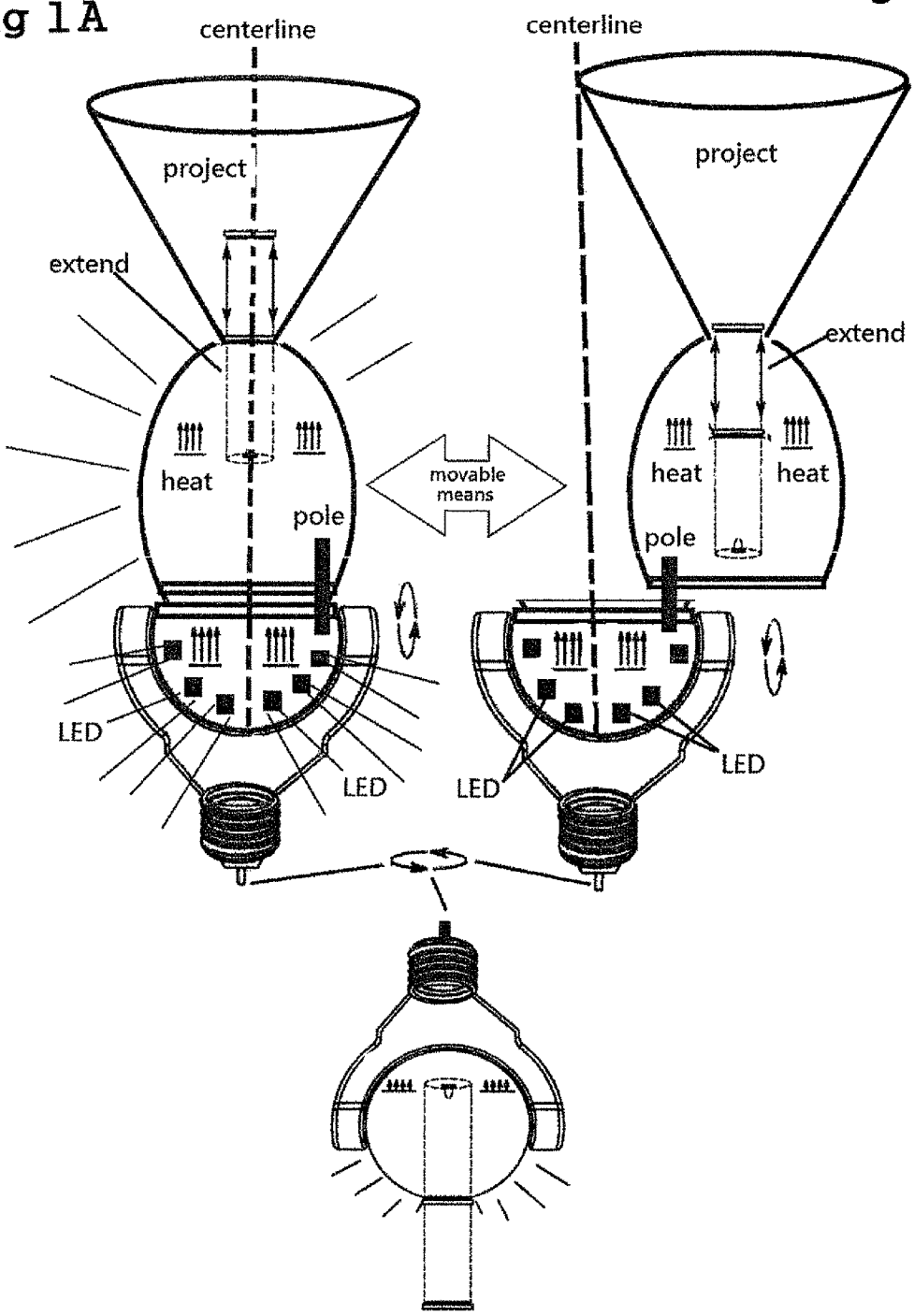
FIGS. 1A, 1B, and IC show a first embodiment of an LED Bulb having more than one level (parts or accessories) that can be moved to desired locations or places by movable-means to obtain desired LED bulb functions, performance, and effects by two movable arms joined with a body (which can have any shape to enable rotation, angle adjustment, or position changing of the body by more than 360 degrees, and that includes a base in the form of a screw base of male type for assembly to power supplying female receiving parts.

The drawings of the present application show LED bulbs that are similar to those disclosed in the parent applications and other patent applications of the inventor, but at least some of which differ in that the LED bulb has more than one level and includes movable-means that enable at least one level's parts or accessories to any desire location, position and orientation, with each level having one or more than one functions. It is to be appreciated that other concept, feature or equivalent or same function parts/accessories/electric circuit/or concept disclosed in the inventor's other applications may be included in the LED bulbs of the present invention without departing from the scope of the current invention.

DETAILED DESCRIPTION OF THE PREFERRED EMBODIMENTS

As explained above, the current invention offers a big improvement over conventional market available LED bulbs, which only can offer nearby area illumination and which do not have more than one level or parts or accessories that can change position by movable-means to overcome all kinds of blocking-means and prevent the operation of the LED bulb from being affected by (a) heat created by the LED(s), circuits, or electric components, (b) light beam blocking means that affect or interfere with light emission, (c) signal blocking means that affect or interfere all kinds of electric signal transmission, (d) other block means that destroy desired functions, performance, and effects of the LED bulb. In addition, the current invention offers the improvement that it can provide nearby and faraway illumination, images, or both. Still further, the LED bulb also can have other features such as (1) multiple colors with changeable colors and moving effects; (2) multiple functions selected from market available LED light effects for indoor and outdoor lighting; (3) multiple control means selected from market available control, sensor, switch, Bluetooth, WiFi, Internet, app software, remote, infrared or other electric or electronic related circuits or devices; (4) more than one movable-means; (5) changeable geometric shape; (6) changeable construction; (7) movable means selected from at least one of a bar, pole, spin or rotation mechanism, hinge, arms, joint, frame, connector, or movable sections to enable the levels, parts, or accessories to be moved to a desired location or position.

The LED bulb of the current invention may be controlled by more than one control means selected from a power failure detector, remote control, infrared controller, Bluetooth with mobile phone, WiFi, Internet control, app software control, and/or motion sensor to trigger at least one light beam for illumination or image projection to a desired area(s).

Additional features and embodiments are as follows:

Feature 1: The LED bulb may consist of at least one LED as a light source that emits light beams to desired areas or locations with predetermined illumination, function, time period, and performance.

The LED bulb may further have parts or accessories that allow for projection and adjustment, including optic means, a lens, an adjustable focus means, twist means, rotate means, an elastic contact end, more than one output light beams, a rotating frame, a bulb shade with arms for enabling rotation, a twist bulb base, support for a shade, an LED assembly, LED tubular means, adjustment means, projection means, digital data display means, LCD display means, digital camera means, data storage means, data projection optics means, sensor means, switch means, IC means, circuit means, extend means, extractable means, filter means, stencil means, cutout means, painting means, motion sensor means, remote control means, blue-tooth means, and Internet wireless means, to enable the LED bulb to emit the light beams, images, time, data, digital messages, and Internet data as desired to nearby areas or remote distance areas for illumination.

The LED bulb connects with a power source by contact means in the base to enable the LED bulb to emit light beams to areas with an adjustable angle coverage, preferably in any direction relative to an x-y-z axis coordinate system, or any combination as required for preferred light performance, effects, and functions.

Furthermore, the direction of at least one of the output light beams from the LED bulb can be adjusted to a certain area, location, distance when adjusting the above-listed component(s) of the LED bulb.

The base of the LED bulb may be in the form of male insert means to fit into the female receiving means for a desired construction.

The said LED Bulb at least has adjustable parts to enable the at least one light beam to change position, direction, or orientation.

Feature 2 The LED bulb as above listed (Feature #1), may be provided with an elastic contact means which allows the LED bulb to adjust the light beam position, location, and direction to certain areas in three dimensions.

Feature 3: The LED bulb as above listed (Feature #1) may include extendable, extractable means to enable parts to be extended away from the LED Bulb and that have a configuration and construction that allows installation of some electric parts and accessories, sensor means, motion sensor means, remote control means, heat sensitive means so as to overcome heat and the blocking effects of a lightshade, lens, curtain, glass, cover, cavity depth, or any other blocking means that might interfere with operation of the LED bulb.

Feature 4: The LED bulb as above listed (Feature #1) can incorporate optics means, an optics lens, or an optics lens assembly with parts and accessories that cause the same light beam to have different light performance.

Feature 5: The LED bulb as above listed (Feature #1), may include a focus adjustment means that enables the same light beam to present different light performances at certain locations, positions, and areas with desire brightness, size, and performance.

Feature 6: The frame and support means of the LED Bulb as above listed (Feature #1), may be arranged to enable the bulb to twist, tilt, rotate, spin, and angle-adjust e with hold means to overcome any heat issues and facilitate a change in the desired angle.

Feature 7: The base of the LED bulb as above listed (Feature #1), can have any construction including screw type, pin type, poles type, multiple pole type, twist type, and bayonet type construction.

Feature 8: The LED bulb as above listed (Feature #1) may have more than one light beam output so as to emit more than one light beam to locations, areas, and positions that are remote from the LED Bulb.

Feature 9: The LED bulb as above listed (Feature #1) may include an LED tube means that serves to prevent light leakage from the projection means and ensures that LED light beams passing through the optics means, optics lens, display unit, image forming means, LCD display, Lcos image, and/or digital display of the projection means can be emitted out of the LED Bulb to desired locations, positions, and areas.

Feature 10: The LED bulb as above listed (Feature #1) may include any of a sensor means, switch means, motion sensor means, remote control means, blue-tooth means, photo sensor means or other market-available electric parts and accessories incorporated with circuit means to cause the LED light source to emit light so as to provide predetermined light functions, performance, and effects.

Feature 11: The extension or retractable means of the LED bulb as above listed (Feature #1) can be installed with select electric parts and accessories, with the LED light source being arranged in the LED bulb in an up, down, or horizontal arrangement.

Feature 12: The LED bulb as above listed (Feature #1) can illuminate any combination of nearby or faraway areas to provide both nearby and faraway area lighting effects.

Feature 13: The LED bulb as above listed (Feature #1) may have more than one function that not only offers illumination for nearby areas or remote distance areas, but that also may incorporate motion sensor, remote control, blue-tooth, and other functions.

Feature 14: The extendable and retractable means of the LED bulb may include any heat-sensitive or light blocking-means-affected circuit means, IC means, electric parts and accessories, switch means, sensor means, remote control means, blue-tooth means or equivalent trigger means, extra LEDs, RF receiving means, IR sensor means, or other control means to overcome the effects of the LED's heat or surrounding blocking-means such as a lighting fixture's shade, cover, glass, frame, support, ceiling, wood piece, metal piece, or plastic pieces. The extend means can extend to a certain distance away from the LED's heat or any blocking-means so that the blocking means will not interfere with delivery of the light beams or electric signal delivery direction that might affect the pre-determined functions, performances, and effects of the LED bulb.

Feature 15: The LED bulb may include angle, position, orientation, direction, or focus-adjust means incorporated with optics means, an optics lens, a projection assembly, or an LED assembly. The LED bulb emits the light beam to desire areas in a preferred combination of nearby illumination, faraway illumination, nearby image projection, or faraway image projection, the projection including projection of a digital data image, movie image, internet digital data image, time display, motion picture image, or colorful image.

Feature 16: The LED light beam of the preferred LED bulb may further be triggered by control means which may be selected from one or more of a motion sensor, remote control, infrared sensor, blue-tooth means, power failure means and built-in direct current power storage means, sensor means, switch means, or other electric parts and accessories.

The following detailed description of the drawings include subject matter that was originally included as notes in the original drawings:

FIGS. 1A-1C show the inventor's LED light having more than one level and at least one of the level that can be moved away from its original location or position to overcome blocking-means that interfere with operation of the LED light, including one or more of the following: (a) blocking means that interfere with heat dissipation from the LED and circuits; (b) blocking means that affect light emission; (c) blocking means that affect electric signal transmission; or (d) any other blocking means that affects or interferes with the desired light performance, effects, or functions of the more than one level LED bulb. The LED bulb has at least one movable-means that includes at least one of the following elements: joint-means, rotating means, spin means, hinge means, a bar, a pole, connect means, arms, snake-house means, bend-and-shape means, twist means, retractable means, extendable means, foldable means or any market available skill or method that enables the at least one level to change position, location, or orientation with respect to any of the x-y-z axes of a three-dimensional coordinate system to overcome any of the above-listed blocking-means.

FIGS. 1A-1C show that at least one level of the LED bulb not only can be moved to any location, place, or orientation by the movable-means, but also has an elastic contact base which can be twisted over an angle or circle after the elastic contact base has already make electric-contact with the power source, so that the movable-means and elastic contact base both can enable the LED bulb to achieve a perfect location, place, or orientation to get a desired function, performance, or effects.

FIGS. 2A-2D show a lamp shade having metal blocking-means to interfere with the ability of the bulb's light beam to travel. The lamp shade has a metal frame and accessories to hold the light source. The portion of the metal frame on top of the bulb so will block the emitted light traveling. Similarly, shade caused by a glass, metal, or other electric signal-blocking material will prevent electric signals from being transmitted, the electric signals including WiFi, Bluetooth, remote control, motion sensor, and other signals. In either case, the movable-means is provided to move at least one part of the LED bulb away from the blocking means to allow: (a) heat to be ventilated; (b) light to travel; and/or (c) signal to be transmitted.

Figure 3A:
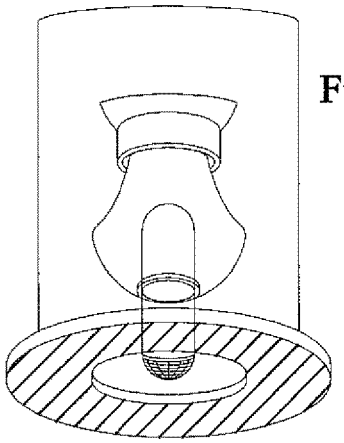
FIG. 3A and FIG. 3B show another embodiment of the LED bulb applied to a downwardly facing light, entrance light, stair light, or recessed light surrounded by blocking-means in the form of a ceiling, walls, or lamp shade made of cement, concrete, metal, porcelain, pottery or any material that blocks transmission of electromagnetic waves or electric signals and therefore affect or interfere with operation of the LED bulb operated by WiFi, Bluetooth, Internet, or app software electric signal delivery, the interference being overcome by the inclusion of movable-means such as retractable, extendable, spinning, or rotating mechanisms, moving arms, a snake hose, or a hinge to move at least one of the LED bulb's levels away from (a) heat sources in the bulb; (b) light blocking means; (c) electric signal transmission blocking means; and/or (d) any other blocking-means related to operation of the LED bulb.
Figure 3B:
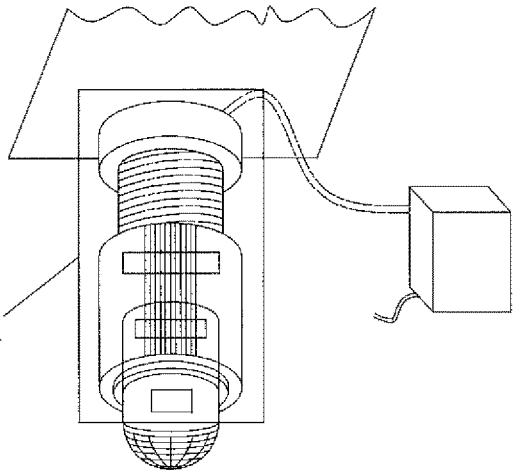
Figure 3C:
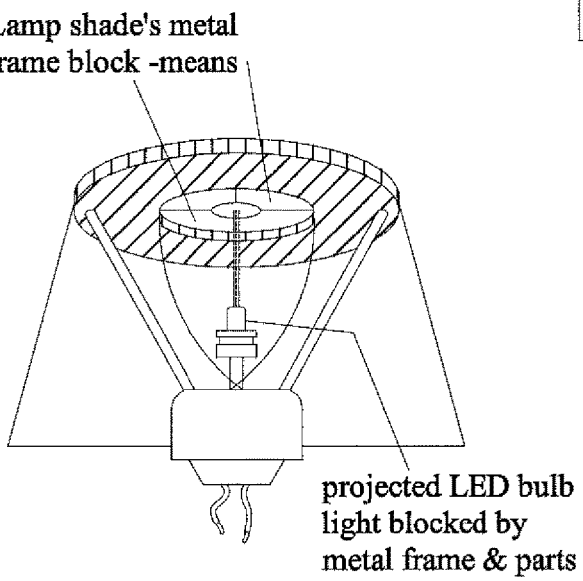
FIGS. 3C and 3D an embodiment with extractable or extendable movable-means as also disclosed in the parent application.
Figure 3D:
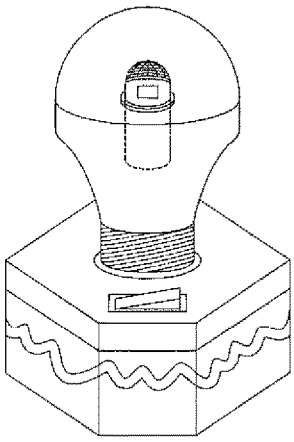

FIGS. 3A to 3B show other blocking-means which interfere with light beams, signals, or heat dissipation and which are overcome by movable-means to enable the LED bulb's parts to move away from the blocking-means.

FIG. 3A shows an LED bulb recessed inside a ceiling for downward illumination, the LED bulb being surrounded by ceiling or wall material. A similar downwardly facing light construction may be used for an entrance door, stairs or evacuation stairs, parking lots, building stairs, and so forth. In these applications, the bulb is surrounded by blocking means in the form of cement, glass, a metal shell, or some material that does not allow electric signals to pass. To overcome this problem, the LED bulb is provided with movable means to cause at least one part of the LED bulb to be moved away from the blocking means to allow the user to achieve a good light arrangement. The blocking materials may include cement, metal, brick, glass, porcelain, pottery or any other material that will interfere with electric signals such as Bluetooth, WiFi, remote control, infrared, electric wave or electronic wave signals. The illustrated LED bulb can be used to replace a non-energy saving incandescent bulb or other non-movable LED bulbs.

FIG. 3B shows a preferred embodiment of a downwardly facing light application that can be used in a building, stairs, entrance door, evacuation stairs, parking lots, public areas, and so forth. The bulb is at least partially blocked by glass or metal or some material which will interfere with light beam emission or electric signal transmission and therefore it is provided with inventor's LED bulb movable-means to move at least one part of the LED Bulb away from the blocking-means to get desired light functions.

Figure 4A:
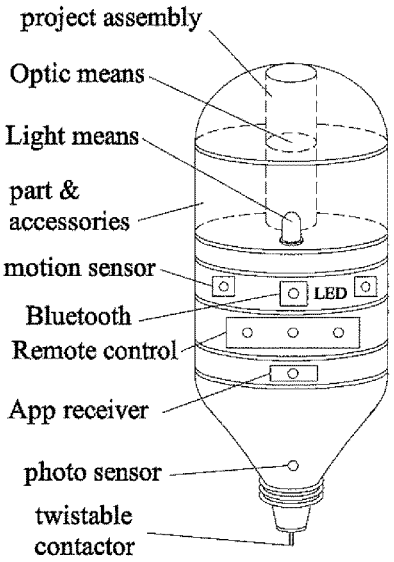
FIGS. 4A, 4B, 4C, 4D, and FIG. 4E show an LED bulb with more than one level and movable-means that enable the LED bulb to change geometric shape as needed, with each level having preferred light functions and added other functions as desired, and each level also having its own control means, sensor means, switch means, IC, circuit, LED(s), optics means, laser means, projection means, and or Bluetooth, WiFi, Internet, or app software means to enable the LED bulb to have more than one function selected from all lighting functions available from the market place, including power fail, emergency light, accent light, garden light, projection light, advertisement light, seasonal light, remote control light, infrared light, sensor light or any combination of multiple LED light features, functions, effects, and performance.

FIG. 4A shows a multiple function LED bulb having a desired combination of functions selected from multiple color LEDs, more than one level, Bluetooth, WiFi, remote control, a motion and/or other kind of sensor, an app signal receiver, CDS, a switch, an IC, a receiver, a trigger, a time delay, and/or automatic, manual or any other electric functions available from the marketplace.

Figure 4B:
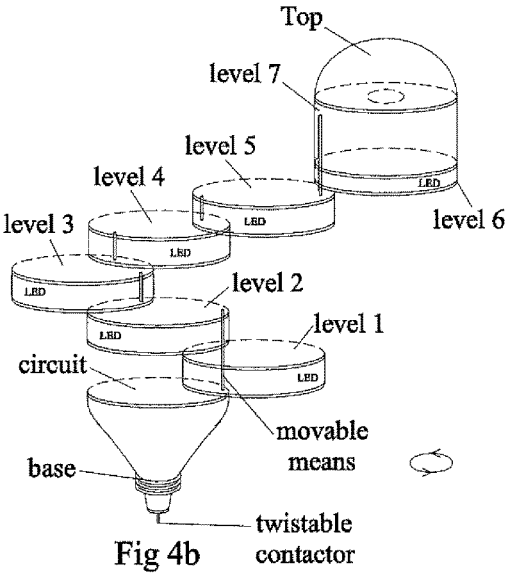

FIG. 4B shows an LED bulb also having more than one function as in FIG. 4A. The LED bulb of FIG. 4B also has multiple levels and each level has its own movable-means to enable each level to rotate on its own to a desired orientation, position, or direction to (1) overcome block-means, or (2) cause an emitted light beam to travel to a desired location, area, or distance, and/or (3) cause each level to have different light functions, color, brightness, turn-on/turn-off time, sensor means, control means, IC means or any combination of light functions available from the marketplace. The LED bulb of FIG. 4B thus has at least the following features: (1) more than one level/units, (2) more than one function, and (3) geometric shape changeable movable means to overcome blocking-means for (a) heat dissipation; (b) light travel; and (c) signal transmission, the movable means being selected from a hinge, bar, pole, rotating or spinning mechanism, retractable or extendable mechanism, snake hose, and so forth.

Figure 4C:
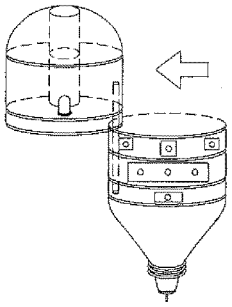

FIG. 4C shows an LED bulb having more than one level, with the different levels including: (1) a projection assembly; (2) illumination LED(s); (3) control means; and (4) remote, Bluetooth, WiFi, and/or app software receiver means.

Figure 4D:
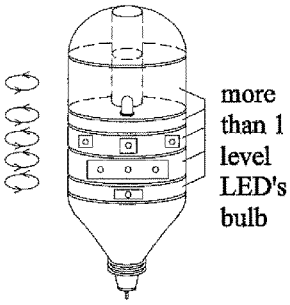
Figure 4E:
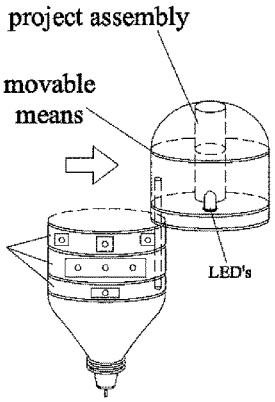

FIG. 4D shows an LED bulb having more than one level and movable-means to cause the level to change its x-y-z location FIG. 4E an LED bulb in which each level has desired functions such as light source, sensor means, switch means, remote control, WiFi, Bluetooth, and app software functions, and that further has movable-means.

FIG. 5A shows a blocking means such as a lamp shade's metal frame that is situated on a center line through the base and the top of the LED bulb, while FIG. 5B shows the manner in which a movable-means is used to move the top parts away from the center line in order to move the projected light away from the blocking means. The illustrated LED bulb also has an elastic electric-contact pole that can be twisted or further rotated to obtain a desired orientation, angle, or position so that the multilevel LED bulb can achieve any orientation, position to allow desired light beams to travel to a certain area or location, whether remote or nearby, and therefore provide desired light performance, functions, and/or effects. FIGS. 5C and 5D also illustrate the manner in which the movable-means moves a projected light beam away from a center line on which a blocking means (such as lamp shade metal frame) is situated.

The movable-means for the LED bulbs of FIGS. 5A-5D may include any of the following elements: a bar, rod, pole, hinge, rotating means, spin means, extractable means, extendable means, snake hose, joint means, connect means, arms, or any other market available means, skill, or method to enable the unit move or change geometric shape, construction, or design in order to overcome interference caused by any kind of blocking-means which at least block (a) heat dissipation, (b) light beam travel, (c) signal transmission, or (d) any other performance, effects, or elements that affect operation of the LED bulb.

FIG. 6A shows an LED bulb having more than one level so that when a projection light beam has been blocked by a lamp shade's metal frame, a movable-means can be used to move the top part of the LED bulb to another location away from the metal frame to allow the projection light beam to project to the ceiling or a desired area, location, or distance, whether nearby or remote.

FIG. 6B is a top view of the two parts of the LED bulb of FIG. 6A. The base is still installed inside the lamp holder, but the top parts are already away from the center line of the socket base and therefore away from the conventional lamp shade's metal frame and center blocking means.

FIG. 6C shows more details for the two part LED bulb, in which the top part not only has a projection assembly but also other LEDs that glow with a desired timing, brightness, color, or color changing, and that further includes other optics means or circuit means, IC means, control means, sensor means, WiFi means, Bluetooth means and any other market available means for LED light functions, effects, performance, and so forth.

FIG. 6C shows that the circuit means are inside the base within a channel (the movable means being a pole, the center of the pole being empty to allow electric wires to pass through and reach the top part of the LED bulb and offer electric power and signals for the electric functions carried out there.

FIGS. 7A-7C show an LED bulb having movable-means in the form of a snake hose so that the LED bulb can be moved to any desired location, place, or orientation to get good light functions.

FIG. 7A shows an LED bulb having an elastic contact base inserted into a separate snake hose means so that the LED bulb can be moved to any desired location.

FIGS. 7B and 7C show an LED bulb having a built-in snake hose movable-means arranged so that the top parts have a first movable-means and the base has a second snake hose movable-means, thereby providing more than one movable means for one LED bulb This arrangement is useful for a variety of applications such as, by way of example and not limitation, an outdoor security light to connect with an old existing lamp holder, enabling a desired light beam to be emitted to certain areas.

Figure 8A:
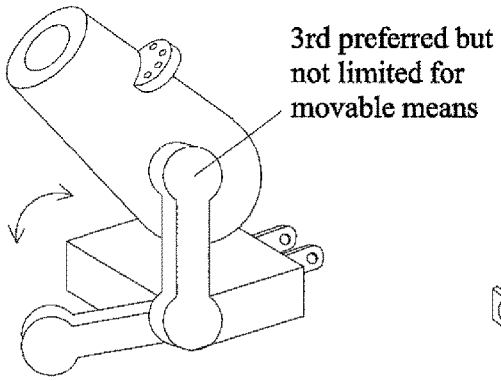
FIGS. 8A, 8B, 8C and 8D show movable-means in the form of movable arms, rods, joints, bars, tubes, or poles to enablement movement of at least one level's parts and accessories to a desired location, position, or orientation, and in which LED bulb has a top part, a middle part, and a base part or further has second parts, third parts, fourth parts, and so forth

The first movable means of FIG. 8A may be selected from joint means, spin means, arms, a bar, rotating means, extendable and retractable means, and connector means that enable parts to change geometric shape, construction, distance, orientation, position, or location.

Figure 8B:
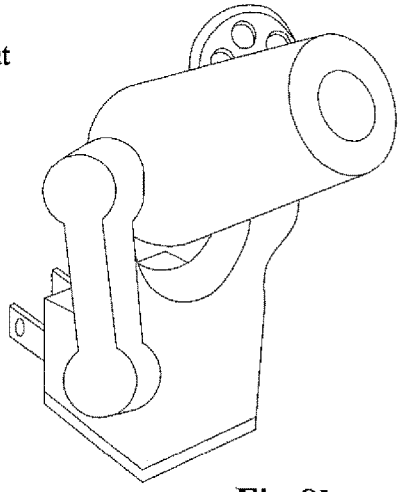
Figure 8C:
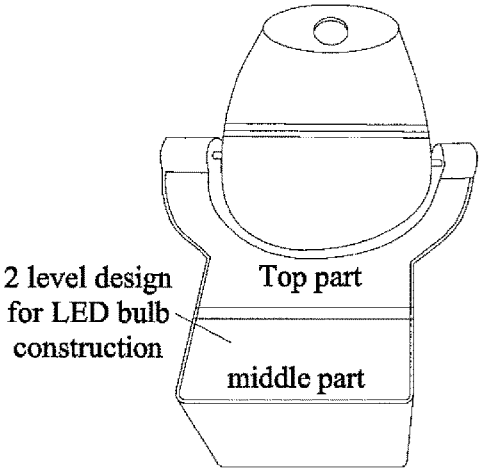
Figure 8D:
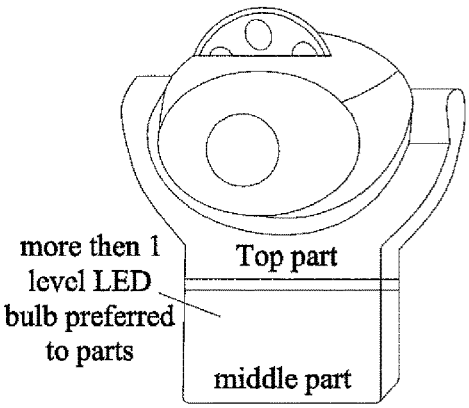
Figure 9A:
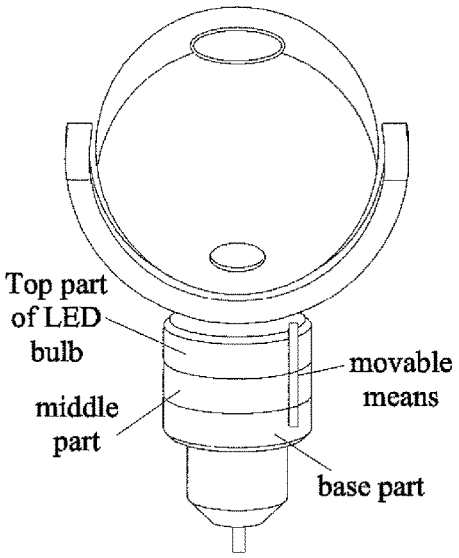
FIGS. 9A, 9B, 9C, and 9D show additional alternative and preferred geometric shapes for an LED bulb having more than one level and in which a desired level or levels can be moved to any location, position, or orientation.
Figure 9B:
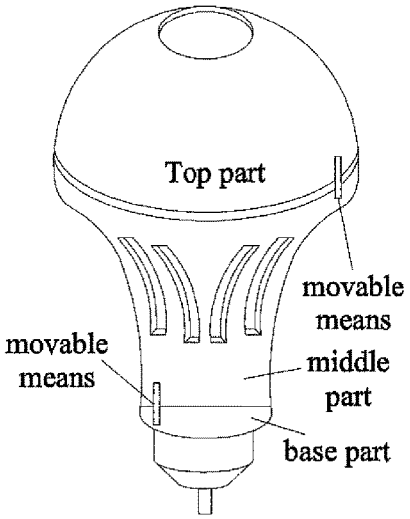
Figure 9C:
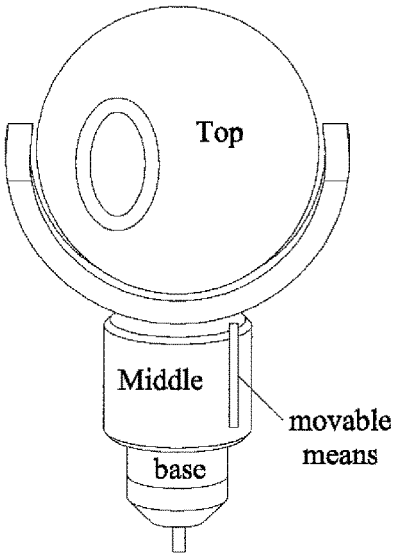
Figure 9D:
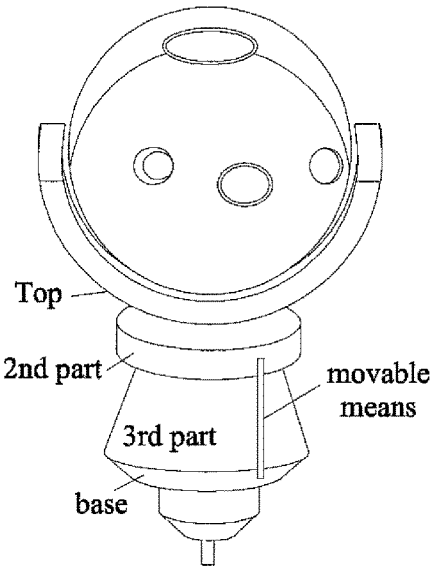

FIGS. 8C and 8D show that the LED bulb design can have any geometric shape and any type of bulb base available in the marketplace, including a socket base, pin base, pole base, screw base, pole and twist base, or any incandescent bulb base.

It will be appreciated that the movable means of FIG. 8A and FIG. 8B is not limited to a particular movable-means, but rather can include arms, rotating means, joint means, and so forth.

FIGS. 9A-9D also show a multiple level LED bulb having movable-means to overcome blocking means, each of the multiple levels having its own light functions incorporated with market available WiFi, Bluetooth, motion or other sensor, switch, app software, remote control, means to carry out pre-determined control functions, light functions, effects, and performance.

As shown in FIGS. 9A-9D, the LED bulb's functions may include any combination of nearby or remote illumination, power fail lighting, motion sensor lighting, WiFi controlled remote lighting, a Bluetooth sensor light, an app software controlled light, a projection light, a color changing light, a multiple color light, a reading light, a night light, an accent light, a dot-matrix LED light, an IC controlled light, or others light functions available from the marketplace.

The invention claimed is:

1. An LED bulb, comprising:

at least one LED and projection means for projecting light beams or images from the at least one LED onto a surface remote from the LED bulb, wherein the LED bulb has more than one level and the projection means is on a top level, wherein a base level includes electric parts and accessories for connection to a power source and for triggering and controlling the at least one LED, and wherein the LED bulb further includes movable means for causing relative movement between at least the top level and the base level to prevent interference or blocking, by a blocking means that is part of a fixture in which the LED bulb is installed, of light beams projected by the projection means onto said surface remote from the LED bulb, said blocking means being situated, before said relative movement, between the projection means and the surface remote from the LED bulb.

2. An LED bulb, comprising:

at least one LED, wherein the LED bulb has more than one level and at least one movable means for changing the position or orientation of a first said level relative to a second said level, wherein each of said levels has at least one lighting function, at least one lighting control function, at least one remote control function, or at least one sensor control function, wherein the respective functions on each of said levels are different from each other, and wherein the movable means is arranged to move the first level relative to the second level in order to prevent blocking by a blocking means that is part of a fixture into which the LED bulb is installed, said blocking means being for blocking one of the following: heat dissipation from the LED and electrical components; light emission by the LED bulb, and electromagnetic signal transmission.

3. An LED bulb as claimed in claim 2, wherein the levels are relatively movable by movable means including elements selected from one or more of the following: joint means, rotating means, spin means, a hinge; a bar; a pole; a connector; arms; bend-and-shape means; twist means; retractable means; extendable means; foldable means, and snake hose means, said elements being arranged to move one of the levels relative to another of the level in order to prevent blocking by a blocking means, said blocking means being for blocking one of the following: heat dissipation from the LED or electrical components; light emission by the LED bulb, and electromagnetic signal transmission.

4. An LED bulb as claimed in claim 2, wherein said at least one lighting function is selected from the group consisting of light projection; power failure lighting; color changing lighting; IC controlled lighting; remotely controlled lighting; infrared controlled lighting; motion sensor controlled lighting; photosensor controlled lighting; indoor lighting; and outdoor lighting.

5. An LED bulb as claimed in claim 2, wherein a number of said levels is greater than two.

6. An LED bulb as claimed in claim 2, wherein a base of the LED bulb is one of a screw base, pin type base, pole type base, multiple pole type base, twist base, and bayonet base.

7. An LED bulb, comprising:

at least one LED, wherein the LED bulb has more than one level, at least one of which is movable relative to another level, wherein each of said levels has at least one function that is different from at least one function of another one of the levels, and wherein the different functions are selected from the group consisting of light projection; power failure lighting control; color changing lighting control; IC lighting control; remote lighting control; infrared-lighting control; motion sensor lighting control; photosensor lighting control; indoor lighting; and outdoor lighting.

8. An LED bulb, comprising:

at least one LED, wherein the LED bulb has at least three relatively movable levels, wherein said levels have different lighting, lighting control, remote control or sensor control functions, wherein electrical parts and accessories for said functions are contained within respective levels and inaccessible from outside a housing of the level to prevent contact with the electrical or electronic parts and accessories, and wherein the electrical or electronic parts and accessories are selected from at least one of the following elements: an IC; a switch; a sensor; Bluetooth, infrared, or remote controller; a WiFi controller; and an elastic contact base.

9. An LED bulb as claimed in claim 8, wherein the levels are relatively movable by movable means including elements selected from one or more of the following: joint means, rotating means, spin means, a hinge; a bar; a pole; a connector; arms; bend-and-shape means; twist means; retractable means; extendable means; foldable means, and snake hose means, said elements being arranged to move one of the levels relative to another of the level in order to prevent blocking by a blocking means, said blocking means being for blocking one of the following: heat dissipation from the LED or electrical components; light emission by the LED bulb, and electromagnetic signal transmission.

10. An LED bulb as claimed in claim 2, wherein the different functions are selected from the group consisting of light projection; power failure lighting; color changing lighting; IC controlled lighting; remotely controlled lighting; infrared controlled lighting; motion sensor controlled lighting; photosensor controlled lighting; indoor lighting; and outdoor lighting.

11. An LED bulb as claimed in claim 8, wherein a number of said levels is at least two.

12. An LED bulb as claimed in claim 8, wherein a number of said level is greater than two.

13. An LED bulb as claimed in claim 8, further comprising adaptor means for relatively moving said levels, said adaptor means having one end arranged to be inserted into a lamp socket and another end that receives the LED bulb base.

14. An LED bulb as claimed in claim 13, wherein said adaptor means has a built-in control means, the control means being selected from one of a motion sensor, remote control, magnetic means, WiFi controller, Bluetooth controller, and controller circuitry or components.

15. An LED bulb as claimed in claim 13, wherein said adaptor means includes a snake hose.

16. An LED bulb as claimed in claim 8, wherein a base of the LED bulb is one of a screw base, pin type base, pole type base, multiple pole type base, twist base, and bayonet base.

17. An LED bulb as claimed in claim 8, wherein one of said levels includes a projection means for projecting light beams or images from the at least one LED.

* * * * *